US011468762B2

(12) United States Patent
Skowron

(10) Patent No.: US 11,468,762 B2
(45) Date of Patent: Oct. 11, 2022

(54) FACILITY ALERT SYSTEM

(71) Applicant: Joseph Skowron, Rockledge, FL (US)

(72) Inventor: Joseph Skowron, Rockledge, FL (US)

( * ) Notice: Subject to any disclaimer, the term of this patent is extended or adjusted under 35 U.S.C. 154(b) by 175 days.

(21) Appl. No.: 17/143,350

(22) Filed: Jan. 7, 2021

(65) Prior Publication Data

US 2021/0217294 A1 Jul. 15, 2021

Related U.S. Application Data

(60) Provisional application No. 62/958,815, filed on Jan. 9, 2020.

(51) Int. Cl.

| | |
|---|---|
| ***G08B 25/01*** | (2006.01) |
| ***G08B 3/10*** | (2006.01) |
| ***G08B 5/22*** | (2006.01) |
| ***G08B 5/36*** | (2006.01) |
| ***G08B 27/00*** | (2006.01) |
| ***G08B 25/00*** | (2006.01) |
| ***G08B 25/10*** | (2006.01) |

(52) U.S. Cl.

CPC ..... *G08B 25/016* (2013.01); *G08B 3/1016* (2013.01); *G08B 5/223* (2013.01); *G08B 5/36* (2013.01); *G08B 25/001* (2013.01); *G08B 25/006* (2013.01); *G08B 25/10* (2013.01); *G08B 27/005* (2013.01)

(58) Field of Classification Search

CPC .... G08B 25/016; G08B 3/1016; G08B 5/223; G08B 5/36; G08B 25/006; G08B 25/10; G08B 27/005

See application file for complete search history.

(56) References Cited

U.S. PATENT DOCUMENTS

| | | | | |
|---|---|---|---|---|
| 7,460,020 | B2 | 12/2008 | Reyes et al. | |
| 7,502,609 | B2 * | 3/2009 | Kayzar | H04M 3/42153 455/418 |
| 7,616,942 | B2 | 11/2009 | Karl et al. | |
| 7,706,843 | B2 * | 4/2010 | Kaplan | H04M 1/724 340/7.61 |
| 8,819,855 | B2 | 8/2014 | Prasad et al. | |
| 9,466,188 | B2 * | 10/2016 | Hamam | G06F 3/016 |
| 9,553,992 | B1 | 1/2017 | Harnisch | |
| 10,373,450 | B2 * | 8/2019 | Mandlakazi | G08B 5/36 |
| 11,113,951 | B2 * | 9/2021 | Umemoto | G08B 5/36 |
| 2005/0073426 | A1 * | 4/2005 | Hines | G08B 25/016 340/691.1 |

(Continued)

*Primary Examiner* — John A Tweel, Jr.
(74) *Attorney, Agent, or Firm* — Boudwin Intellectual Property; Daniel Boudwin

(57) ABSTRACT

A facility alert system is provided. The system includes a plurality of remote units, wherein each unit includes a housing having a plurality of controls thereon. Each of the plurality of remote units is in wireless communication with each other via a wireless transceiver disposed within the housing. Each of the plurality of controls illuminates a corresponding indicator light disposed on each housing of the plurality of remote units when actuated. Upon actuation of one of the plurality of controls, an alert signal is transmitted to emergency services via the wireless transceiver. In some embodiments, a vibration motor is disposed within each housing, whereupon actuation of one of the plurality of controls, each vibration motor activates to vibrate each housing in a pattern corresponding to each control.

20 Claims, 4 Drawing Sheets

(56) References Cited

U.S. PATENT DOCUMENTS

| | | | | |
|---|---|---|---|---|
| 2014/0273911 | A1 | 9/2014 | Dunn et al. | |
| 2015/0130609 | A1* | 5/2015 | Jacobs | G08B 27/00 340/517 |
| 2016/0217679 | A1 | 7/2016 | McNutt et al. | |
| 2017/0069196 | A1* | 3/2017 | Jacobs | G08B 27/00 |
| 2018/0151037 | A1* | 5/2018 | Morgenthau | G08B 25/016 |

* cited by examiner

FACILITY ALERT SYSTEM

CROSS REFERENCE TO RELATED APPLICATIONS

This application claims the benefit of U.S. Provisional Application No. 62/958,815 filed on Jan. 9, 2020. The above identified patent application is herein incorporated by reference in its entirety to provide continuity of disclosure.

BACKGROUND OF THE INVENTION

The present invention relates to facility alert systems. More particularly, the present invention pertains to a facility alert system comprising a series of distinct housings distributed through a building complex, wherein each housing is configured to alert individuals in the building complex of an emergency while contacting appropriate emergency services.

Many building complexes house multiple separate businesses, companies, or otherwise subdivided structures that infrequently interact with each other. Such building complexes can be utilized for professional, recreational, or other purposes. For example, church complexes may simultaneously operate church services, bible study, choir practice, and the like, while business complexes may house several separate company office complexes. As communication tends to be limited between such subdivided sections of the complex, it can be difficult to alert the entire building complex of an emergency situation that may impact the occupants of the entire complex.

Furthermore, a variety of different emergency situations may affect any such building complex, each of which may require separate response procedures to ensure the occupants' safety. For example, in the event of a fire, quick and orderly evacuation of the building is generally preferred, whereas during an active shooter emergency, sheltering in place tends to be the safest course of action. Failure to alert all occupants of the building complex of the presence of an emergency, as well as the nature of the emergency, can result in severe injury or death of the occupants. Therefore, a device that can alert an entire building complex of the presence of an emergency, while also alerting proper emergency services entities of the emergency is desired.

In light of the devices disclosed in the known art, it is submitted that the present invention substantially diverges in design elements from the known art and consequently it is clear that there is a need in the art for an improvement to existing facility alert systems. In this regard, the instant invention substantially fulfills these needs.

SUMMARY OF THE INVENTION

In view of the foregoing disadvantages inherent in the known types of facility alert systems now present in the known art, the present invention provides a facility alert system wherein the same can be utilized for providing convenience for the user when alerting several distinct locations within a building complex of an emergency while automatically contacting the appropriate emergency services.

The present system comprises a plurality of remote units, wherein each remote unit comprises a housing having a plurality of controls thereon. Each of the plurality of remote units is in wireless communication with each other via a wireless transceiver disposed within the housing. Each of the plurality of controls illuminates a corresponding indicator light disposed on each housing of the plurality of remote units when actuated. Upon actuation of one of the plurality of controls, an alert signal is transmitted to emergency services via the wireless transceiver. In some embodiments, a vibration motor is disposed within each housing, wherein the vibration motor activates to vibrate each housing in a pattern corresponding to each control when one of the plurality of controls is actuated.

In some embodiments, each of the plurality of controls corresponds to a distinct emergency response, such that the alert signal is transmitted to an appropriate emergency services branch. In another embodiment, each of the indicator lights comprises a distinct color. In other embodiments, a sliding switch is disposed on each housing, the sliding switch configured to selectively adjust a frequency on which the wireless transceiver communicates. In yet another embodiment, a speaker is disposed on each housing of the plurality of remote units, wherein each speaker is configured to emit an audible alert when one of the plurality of controls on one of the plurality of remote units is actuated. In some embodiments, the audible alert is unique to each control of the plurality of controls. In another embodiment, a battery compartment is disposed within each housing, wherein the battery compartment includes a removable door. In other embodiments, a fastener is disposed on a rear surface of each housing, wherein the fastener is configured to removably secure the housing to a support surface. In yet another embodiment, the fastener comprises a pair of adhesive strips disposed across an upper end and a lower end of the rear surface. In some embodiments, each indicator light comprises a strip extending between each control of the plurality of controls and an edge of the housing.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
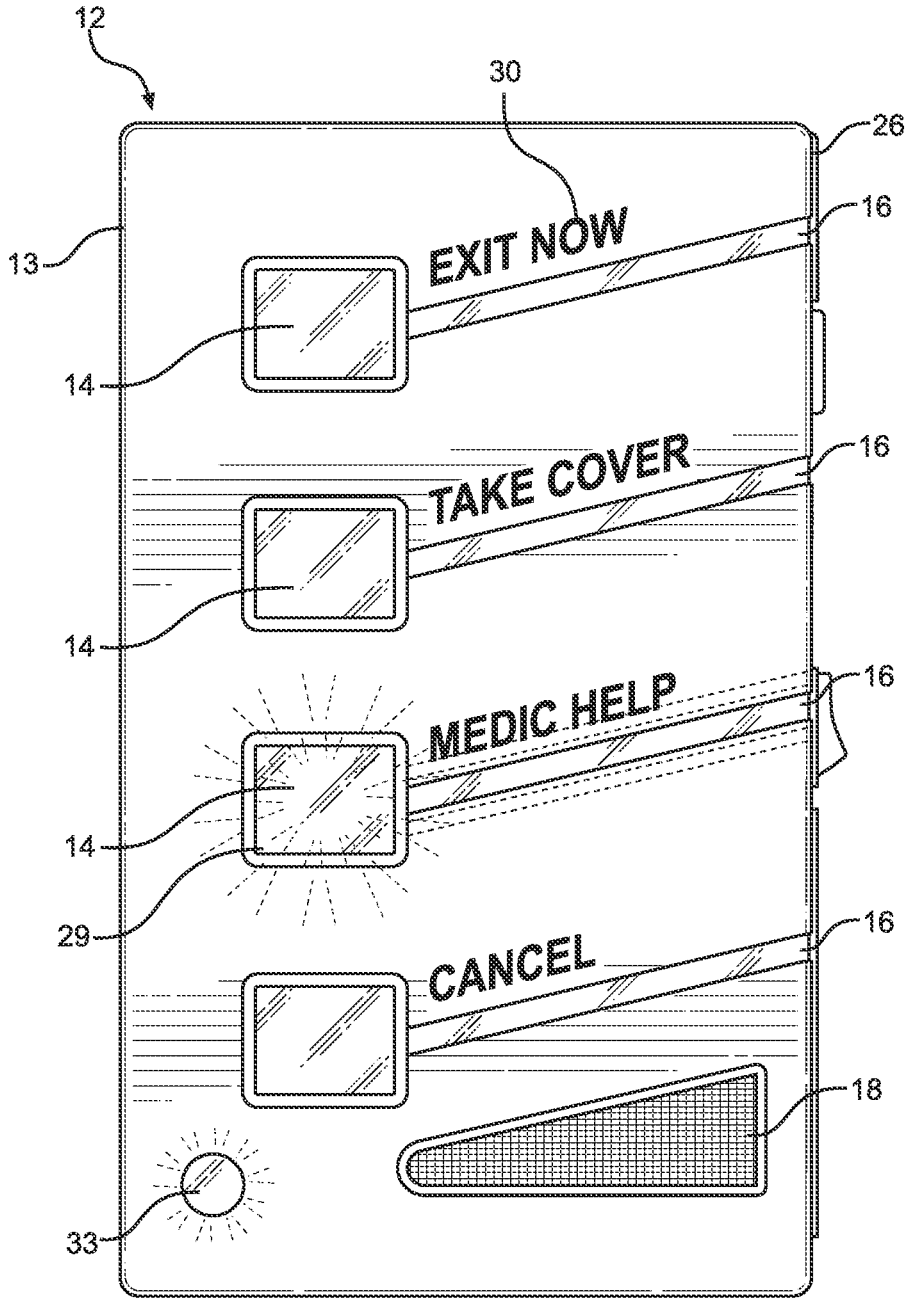
FIG. 1 shows a front view of a remote unit of an embodiment of the facility alert system.

Reference is made herein to the attached drawings. Like reference numerals are used throughout the drawings to depict like or similar elements of the facility alert system. The figures are intended for representative purposes only and should not be considered to be limiting in any respect.

According to some embodiments, the operations, techniques, and/or components described herein can be implemented as (i) a special-purpose computing device having specialized hardware and a logic hardwired into the computing device to persistently perform the disclosed operations and/or techniques or (ii) a logic that is implementable on an electronic device having a general purpose hardware processor to execute the logic and a computer-readable medium, e.g. a memory, wherein implementation of the logic by the processor on the electronic device provides the electronic device with the function of a special-purpose computing device.

In the interests of economy, the present disclosure refers to "a computer-readable medium," "a processor" and so on. However, this should not be read as limiting in any way as the present disclosure contemplates embodiments of the present invention utilizing "one or more computer-readable media," "one or more processors," and so on. Unless specifically limited to a single unit, "a" is intended to be equivalent to "one or more" throughout the present disclosure.

Referring now to FIG. 1, there is shown a front view of a remote unit of an embodiment of the facility alert system. The facility alert system comprises a plurality of remote units 12 each comprising a housing 13 having a plurality of controls 14 thereon. The plurality of controls 14 are configured to selectively activate an alarm corresponding to each of the plurality of controls 14 across all remote units 12 of the facility alert system, as further described elsewhere herein. In this manner, the alarm can be spread through a building complex to alert the entire complex to an emergency. In the illustrated embodiment, the plurality of controls 14 are disposed on a front side of the housing 13, wherein indicia 30 are disposed adjacent to each control of the plurality of controls 14. The indicia 30 corresponds to a particular emergency response protocol, advising those in the vicinity to take appropriate measures to minimize the risks associated with the particular emergency. For example, the shown embodiment includes indicia 30 alerting users to either exit the building complex immediately, take cover, or to summon medical assistance.

Figure 4:
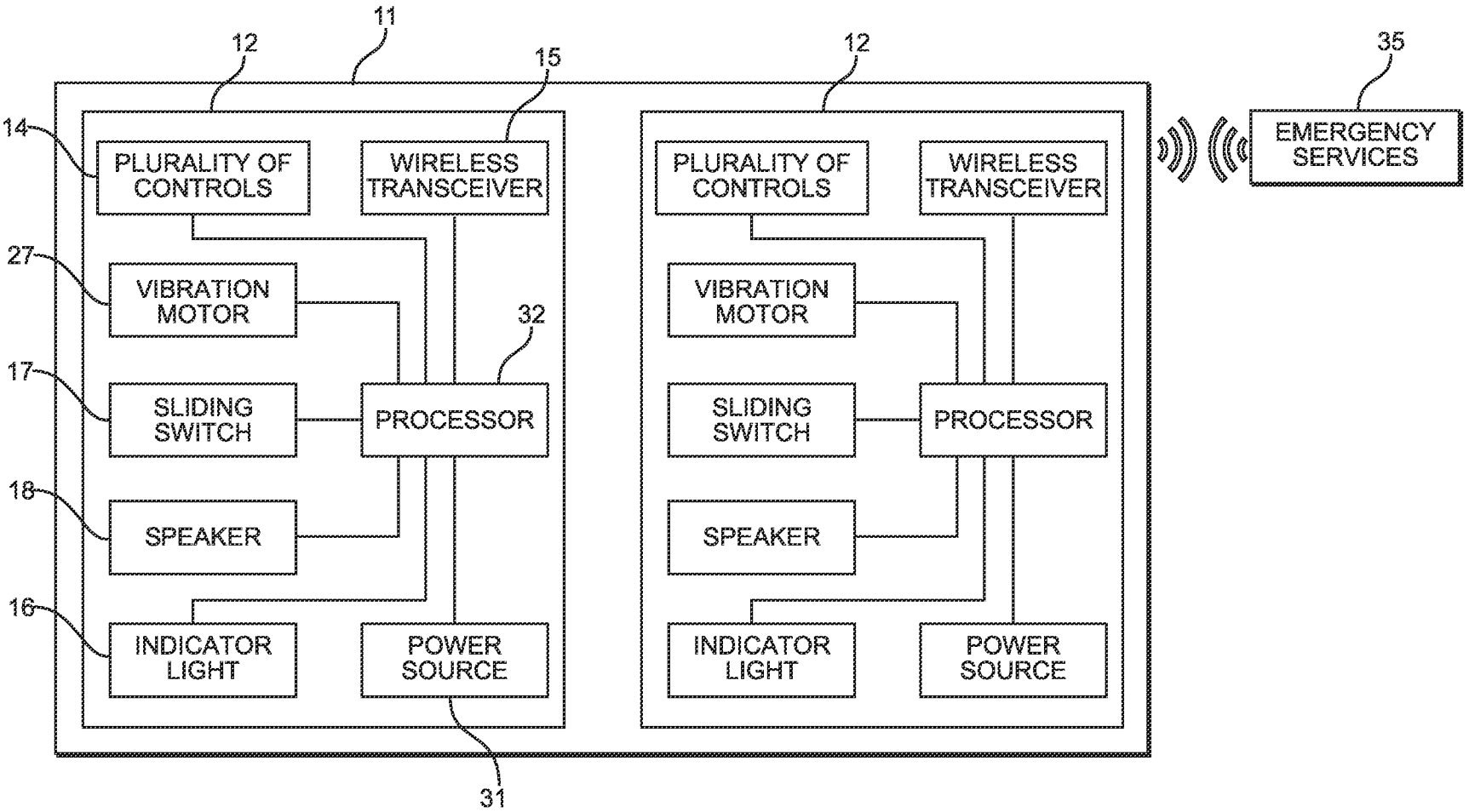
FIG. 4 shows a schematic view of an embodiment of the facility alert system.

An indicator light 16 is disposed adjacent to each of the plurality of controls 14, wherein each indicator light 16 is configured to illuminate when a corresponding control of the plurality of controls 14 is actuated. In some embodiments, the indicator lights 16 are configured to illuminate in a particular pattern unique to each control of the plurality of controls 14, allowing a user to quickly visualize which control was actuated at a glance. Additionally, in some embodiments, each indicator light 16 comprises a distinct and unique color. Furthermore, upon actuation of one of the plurality of controls 14, a signal is transmitted to each of the plurality of remote units 12 via a wireless transmitter (as shown in FIG. 4, 15) disposed within each housing 13. In this manner, the indicator lights 16 inform users throughout a building complex of the activation of the alarm. In the illustrated embodiment, the indicator lights 16 comprise a strip extending between each control of the plurality of controls 14 to an edge 26 of the housing 13. In this manner, visibility of the indicator lights 16 is increased. Furthermore, in some embodiments, the indicator lights 16 continue onto a side of the housing 13, such that the user is informed of the activation of the indicator light 16 from multiple viewing angles. In the illustrated embodiment, the indicator light 16 continues around a perimeter 29 of each of the plurality of controls 14 to improve visibility of the indicator lights 16. In the shown embodiment, an activation light 33 is disposed on the housing 13, wherein the activation light 33 is configured to illuminate when the remote unit 12 is activated. In this manner, the user is informed as to when a power source (as shown in FIG. 2, 31) of the remote unit 12 is depleted and must be recharged or replaced.

In the illustrated embodiment, a speaker 18 is disposed on the housing 13, wherein the speaker 18 is configured to emit an audible alert when one of the plurality of controls 14 is actuated. The audible alert can comprise a distinct audible alert associated with each control of the plurality of controls 14, such that a user is readily informed of the nature of the current emergency. Similarly, once a control of the plurality of controls 14 is actuated on one of the plurality of remote units 12, the same audible alert is emitted from the speaker 18 of each remote unit 12. In this manner, individuals can readily distinguish the nature of the emergency without visualizing the housing 13.

Figure 2:
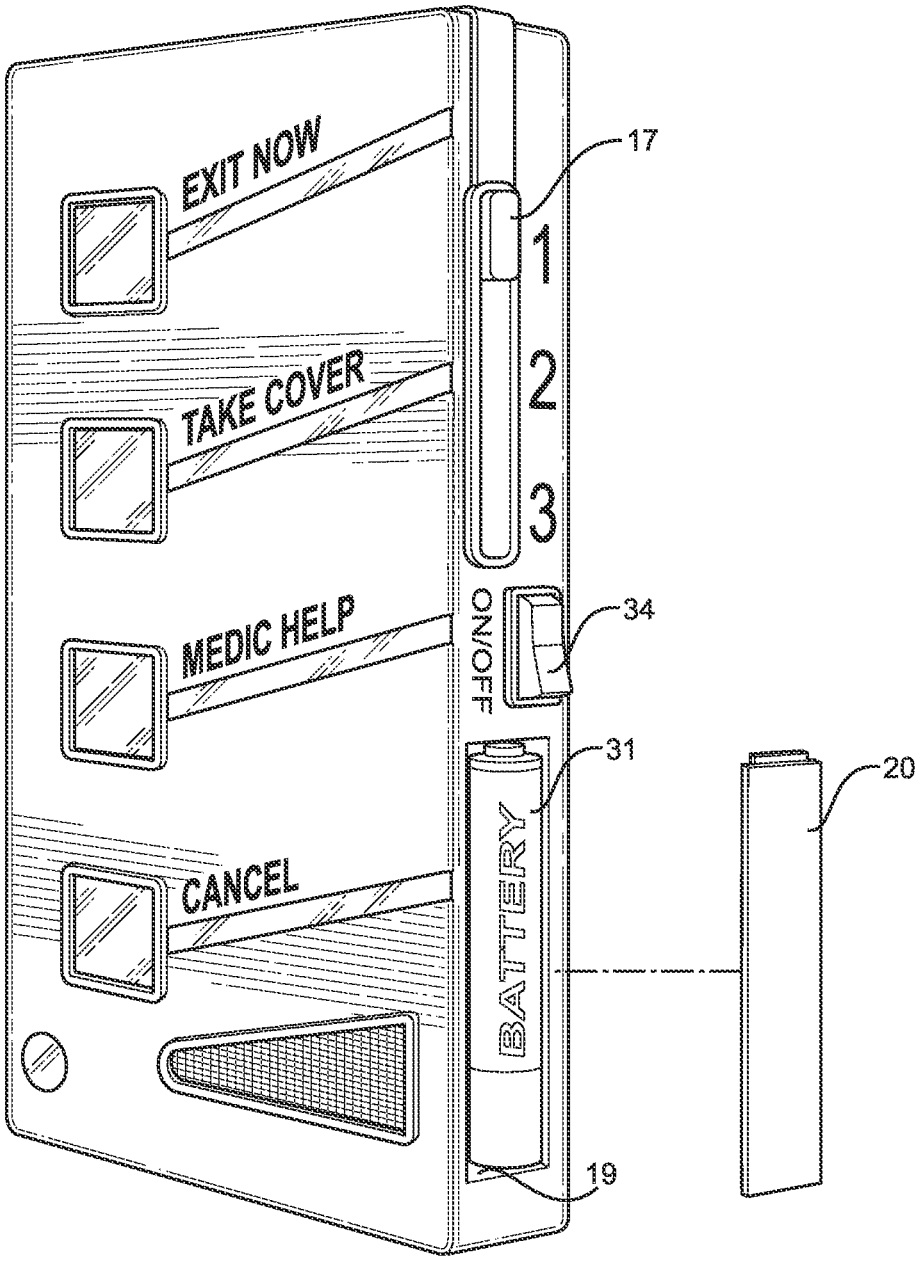
FIG. 2 shows an exploded view of a remote unit of an embodiment of the facility alert system.

Referring now to FIG. 2, there is shown an exploded view of a remote unit of an embodiment of the facility alert system. In the illustrated embodiment, a compartment 19 is disposed within a side of the housing, wherein the compartment 19 is dimensioned to removably secure a power source 31 therein. In the illustrated embodiment, the power source 31 comprises a battery, however, alternate power sources 31 are contemplated, including rechargeable power sources 31. In the shown embodiment, the compartment 19 further includes a removable door 20 configured to enclose the compartment 19. In some embodiments, the removable door 20 includes a biased latch configured to engage the housing to maintain the removable door 20 in a closed position. Furthermore, an activation switch 34 is disposed on the side of the housing, wherein the activation switch 34 is configured to selectively toggle the remote unit between an activated state and a deactivated state, wherein the activated state, the power source 31 supplies power to the electronic components of the remote unit.

In the shown embodiment, a sliding switch 17 is disposed on the side of the housing, wherein the sliding switch 17 is configured to selectively adjust a frequency on which the wireless transmitter communicates with additional remote units. In this manner, several distinct alert systems can be operated simultaneously without interference. In the shown embodiment, the sliding switch 17 is selectively movable between three positions, however, in alternate embodiments, greater or fewer positions are contemplated to provide a variety of frequency selection options. In the illustrated embodiment, each position for the sliding switch 17 is further labeled with indicia to distinguish each frequency setting available.

Figure 3:
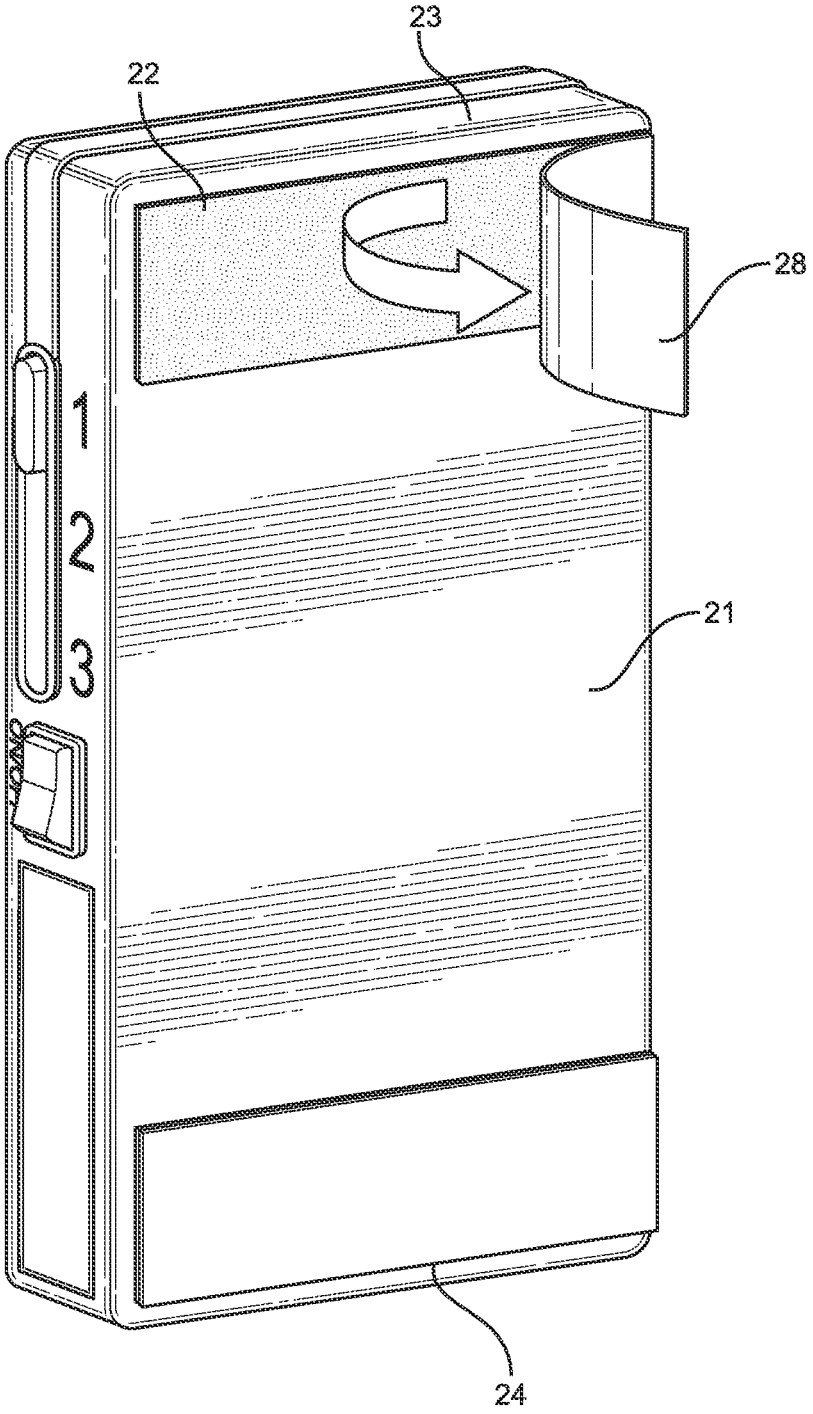
FIG. 3 shows a rear perspective view of a remote unit of an embodiment of the facility alert system.

Referring now to FIG. 3, there is shown a rear perspective view of a remote unit of an embodiment of the facility alert system. In the shown embodiment, a fastener 22 is disposed on a rear surface 21 of the housing, wherein the fastener 22 is configured to removably secure the housing to a support surface, such as a wall. In the illustrated embodiment, the fastener 22 comprises a pair of adhesive strips disposed on an upper end 23 and a lower end 24 of the housing, the pair of adhesive strips extending along an entire width of the rear surface 21, such that the housing is firmly secured to the support surface. In some embodiments, an adhesive cover 28 is disposed over the fastener 22, such that the adhesive cover 28 protects the fastener 22 until the user desires to secure the housing to the support surface. In this manner, the life of the adhesive used for the fastener 22 is extended.

Referring now to FIG. 4, there is shown a schematic view of an embodiment of the facility alert system. The facility alert system 11 comprises a plurality of linked remote units 12, wherein the plurality of remote units 12 are in wireless communication via wireless transceivers 15 disposed within each remote unit 12. The remote units 12 further comprise a processor 32 operably connected to each of the electronic components therein. In the shown embodiment, the processor 32 of each remote unit 12 is operably connected to each of a power source 31, the plurality of controls 14, the wireless transceiver 15, the indicator light 16, the sliding switch 17, the speaker 18, and a vibration motor 27. Upon actuation of one of the plurality of controls 14, the processor 32 illuminates an associated indicator light 16 on each remote unit 12 via transmission of an alert signal via the wireless transceiver 15. In this manner, each remote unit 12 alerts users in the vicinity of the presence of an emergency. In some embodiments, the processor 32 further activates the speaker 18 to emit an audible alarm associated with the actuated control across each remote unit 12 within the facility alert system 11. Additionally, in the illustrated embodiment, the vibration motor 27 is configured to vibrate the housing of each remote unit 12 in a specific pattern corresponding to the actuated control, such that users are further alerted of the presence of an emergency.

Furthermore, in the illustrated embodiment, upon actuation of a control of the plurality of controls 14, the facility alert system 11 is configured to transmit an alert signal to an appropriate branch of emergency services 35, such as law enforcement, fire departments, ambulance services, or any combination thereof for the selected emergency. For example, if one control corresponds to an active shooter emergency, the facility alert system 11 is configured to contact law enforcement and ambulance services. In this manner, upon detection of a particular emergency, a user need only actuate a control on one of the plurality of remote units 12 to transmit the alert to each of the linked remote units 12 of the facility alert system 11. dispersed throughout a building complex. This allows the entire complex to be alerted to a potential emergency situation. Furthermore, emergency services 35 may be contacted immediately upon actuation of one of the plurality of controls 14 to minimize the emergency response time. In other embodiments, emergency services 35 are contacted a set time after actuation of one of the plurality of controls 14 to allow a user to cancel the alert within the set time. In this way, emergency services 35 are not contacted accidentally or in cases of a false alarm.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A facility alert system, comprising:

a plurality of remote units, each remote unit comprising a housing having a plurality of controls thereon;

wherein each of the plurality of remote units is in wireless communication with each other via a wireless transceiver disposed within the housing;

wherein each of the plurality of controls illuminates a corresponding indicator light disposed on each housing of the plurality of remote units when actuated; and whereupon actuation of one of the plurality of controls, an alert signal is transmitted to emergency services via the wireless transceiver.

2. The facility alert system of claim 1, wherein each of the plurality of controls corresponds to a distinct emergency response, such that the alert signal is transmitted to an appropriate emergency services branch.

3. The facility alert system of claim 1, wherein each of the indicator lights comprises a distinct color.

4. The facility alert system of claim 1, further comprising a sliding switch on each housing, the sliding switch configured to selectively adjust a frequency on which the wireless transceiver communicates.

5. The facility alert system of claim 1, further comprising a speaker disposed on each housing of the plurality of remote units, wherein each speaker is configured to emit an audible alert when one of the plurality of controls on one of the plurality of remote units is actuated.

6. The facility alert system of claim 5, wherein the audible alert is unique to each control of the plurality of controls.

7. The facility alert system of claim 1, further comprising a battery compartment disposed within each housing, wherein the battery compartment includes a removable door.

8. The facility alert system of claim 1, further comprising a fastener disposed on a rear surface of each housing, wherein the fastener is configured to removably secure the housing to a support surface.

9. The facility alert system of claim 8, wherein the fastener comprises a pair of adhesive strips disposed across an upper end and a lower end of the rear surface.

10. The facility alert system of claim 1, wherein each indicator light comprises a strip extending between each control of the plurality of controls and an edge of the housing.

11. A facility alert system, comprising:

a plurality of remote units, each remote unit comprising a housing having a plurality of controls thereon;

wherein each of the plurality of remote units is in wireless communication with each other via a wireless transceiver disposed within the housing;

wherein each of the plurality of controls illuminates a corresponding indicator light disposed on each housing of the plurality of remote units when actuated;

further comprising a vibration motor within each housing of the plurality of remote units, whereupon actuation of one of the plurality of controls, each vibration motor activates to vibrate each housing in a pattern corresponding to each control; and whereupon actuation of one of the plurality of controls, an alert signal is transmitted to emergency services via the wireless transceiver.

12. The facility alert system of claim 11, wherein each of the plurality of controls corresponds to a distinct emergency response, such that the alert signal is transmitted to an appropriate emergency services branch.

13. The facility alert system of claim 11, wherein each of the indicator lights comprises a distinct color.

14. The facility alert system of claim 11, further comprising a sliding switch on each housing, the sliding switch configured to selectively adjust a frequency on which the wireless transceiver communicates.

15. The facility alert system of claim 11, further comprising a speaker disposed on each housing of the plurality of remote units, wherein each speaker is configured to emit an audible alert when one of the plurality of controls on one of the plurality of remote units is actuated.

16. The facility alert system of claim 15, wherein the audible alert is unique to each control of the plurality of controls.

17. The facility alert system of claim 11, further comprising a battery compartment disposed within each housing, wherein the battery compartment includes a removable door.

18. The facility alert system of claim 11, further comprising a fastener disposed on a rear surface of each housing, wherein the fastener is configured to removably secure the housing to a support surface.

19. The facility alert system of claim 18, wherein the fastener comprises a pair of adhesive strips disposed across an upper end and a lower end of the rear surface.

20. The facility alert system of claim 11, wherein each indicator light comprises a strip extending between each control of the plurality of controls and an edge of the housing.

* * * * *